US011248285B2

(12) United States Patent
Bettini et al.

(10) Patent No.: US 11,248,285 B2
(45) Date of Patent: Feb. 15, 2022

(54) DUPLEX STAINLESS STEEL

(71) Applicant: SANDVIK INTELLECTUAL PROPERTY AB, Sandviken (SE)

(72) Inventors: Eleonora Bettini, Sandviken (SE); Raghuveer Gaddam, Sandviken (SE); Karin Antonsson, Sandviken (SE); Guocai Chai, Sandviken (SE); Christina Haraldsson, Sandviken (SE); Siriki Raveendra, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 82 days.

(21) Appl. No.: 16/613,512

(22) PCT Filed: May 22, 2018

(86) PCT No.: PCT/EP2018/063386

§ 371 (c)(1),
(2) Date: Nov. 14, 2019

(87) PCT Pub. No.: WO2018/215466

PCT Pub. Date: Nov. 29, 2018

(65) Prior Publication Data

US 2021/0156013 A1 May 27, 2021

(30) Foreign Application Priority Data

May 22, 2017 (EP) ..... 17172213

(51) Int. Cl.
*C22C 38/48* (2006.01)
*C21D 6/00* (2006.01)

(52) U.S. Cl.
CPC ..... *C22C 38/48* (2013.01); *C21D 6/004* (2013.01); *C21D 2211/001* (2013.01); *C21D 2211/005* (2013.01)

(58) Field of Classification Search
None
See application file for complete search history.

(56) References Cited

FOREIGN PATENT DOCUMENTS

| | | | | |
|---|---|---|---|---|
| EP | 1 061 151 | A1 | 12/2000 | |
| JP | 2017-002352 | A | 1/2017 | |
| JP | 2017002352 | A * | 1/2017 | |
| WO | WO-2016162525 | A1 * | 10/2016 | ..... C22C 38/44 |

OTHER PUBLICATIONS

International Search Report and Written Opinion dated Aug. 23, 2018, issued in corresponding International Patent Application No. PCT/EP2018/063386.

* cited by examiner

*Primary Examiner* — Seth Dumbris
*Assistant Examiner* — Kim S. Horger
(74) *Attorney, Agent, or Firm* — Morgan, Lewis & Bockius LLP

(57) ABSTRACT

The present disclosure relates to a new duplex stainless steel. Furthermore, the present disclosure relates to a product comprising the duplex stainless steel, which method comprises the step of performing a heat treatment on an object comprising the duplex stainless steel at a predetermined temperature and during a predetermined time.

15 Claims, 1 Drawing Sheet

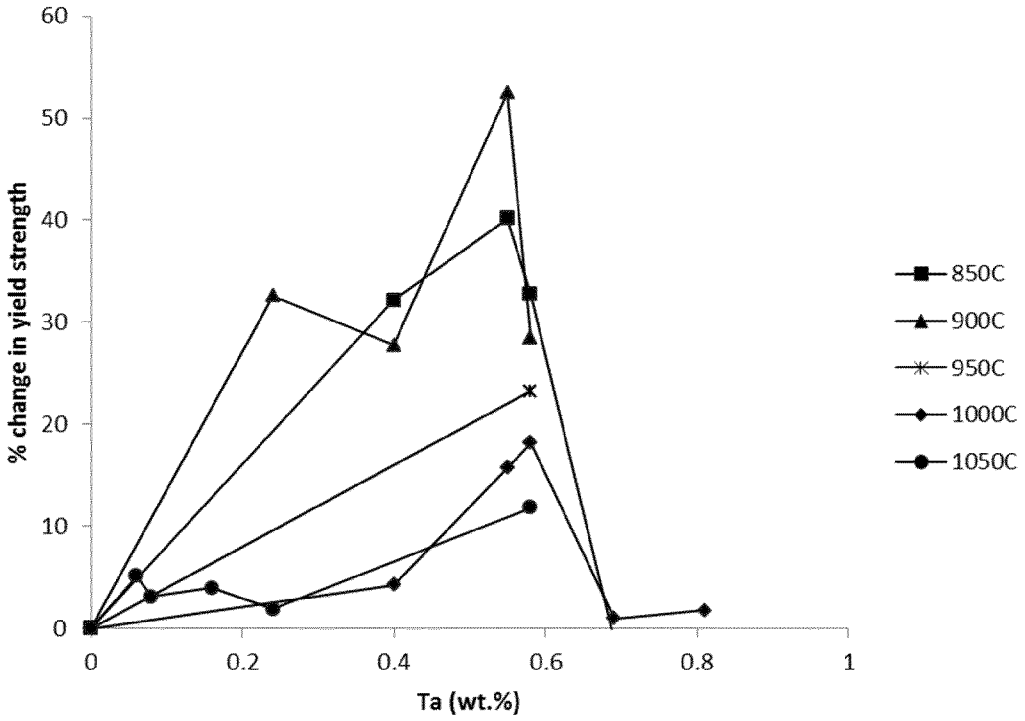
60
50
40
30
20
10
0
% change in yield strength
0
0.2
0.4
0.6
0.8
1
Ta (wt.%)
850C
900C
950C
1000C
1050C

DUPLEX STAINLESS STEEL

TECHNICAL FIELD

The present disclosure relates to a new duplex stainless steel. Furthermore, the present disclosure relates to a product comprising the duplex stainless steel and to a manufacturing method for the product. The manufacturing method comprises a step of heat treating an object comprising the duplex stainless steel at a predetermined temperature and during a predetermined time.

BACKGROUND

Duplex stainless steels are a group of stainless steels which has a two-phase structure, namely austenitic and ferritic phase. These steels usually have a combination of good mechanical properties (such as strength and toughness) and good corrosion resistance. However, in certain applications, there is a need for a duplex stainless steel having even higher strength and which also can be manufactured for a reasonable price, i.e. containing lower amount of expensive alloying elements.

The aim of the present disclosure is to provide a duplex stainless steel which has a combination of high strength and high ductility and good corrosion resistance and which may be manufactured for a reasonable price.

SUMMARY

The present disclosure therefore provides a duplex stainless steel comprising in weight % (wt %):

C less than or equal to 0.03;
Si less than or equal to 1.0;
Mn less than or equal to 2.0;
Mo less than or equal to 0.5;
P less than or equal to 0.05;
S less than or equal to 0.05;
N 0.05 to 0.20;
Ni 3.5 to 5.5;
Cr 21 to 24;
Ta 0.05 to 0.65;
balance Fe and unavoidable impurities and having a ferrite:austenite volume fraction of 35:65 to 65:35.

The alloying element tantalum (Ta) is usually added to a steel alloy for obtaining either a grain refinement effect or for stabilizing the microstructure. However, Ta is usually not added to duplex stainless steels as these steels contain high amounts of nitrogen. Ta is well-known to form nitrides and therefore, by adding Ta to a duplex stainless steel, there will be an increased risk for the formation of undesirable precipitates, which in turn will reduce the corrosion resistance. Surprisingly, the present inventors have found that by adding Ta in the specific ranges disclosed herein, the problems above do not occur, instead the strength of the duplex stainless steel is increased.

The present disclosure also relates to products comprising the present duplex stainless steel.

The present disclosure further relates to a method for manufacturing a product comprising the duplex stainless steel as defined hereinabove or hereinafter, wherein the method comprises a step of heat treating an object/a product comprising said duplex stainless at a temperature from 800 to less than 1050° C. during a predetermined time. It has surprisingly been shown that by exposing the duplex stainless steel as defined herein above or hereinafter to this heat treatment step, which may, according to one embodiment, be performed at lower temperatures than usually used in conventional steel manufacturing methods, the strength of the obtained object/product will increase even more.

FIGURES

FIG. 1 discloses the percentage change in yield strength of duplex stainless steels with heats to which Ta has been added in a certain amount and which then have been heat treated.

DETAILED DESCRIPTION

The present disclosure relates a duplex stainless steel comprising in weight % (wt %):

C less than or equal to 0.03;
Si less than or equal to 1.0;
Mn less than or equal to 2.0;
Mo less than or equal to 0.5;
P less than or equal to 0.05;
S less than or equal to 0.05;
N 0.05 to 0.20;
Ni 3.5 to 5.5;
Cr 21 to 24;
Ta 0.05 to 0.65;
balance Fe and unavoidable impurities and having a ferrite:austenite volume fraction of 35:65 to 65:35.

The duplex stainless steel of the present disclosure is what is called a low alloyed duplex stainless steel meaning that it contains low amounts of Ni. The present inventors have surprisingly found that by adding Ta in the range as disclosed herein to a low alloyed duplex stainless steel, the strength of the duplex stainless steel will be improved and furthermore a combination of high strength and high ductility will be obtained.

According to the present disclosure the volume fraction of ferrite:austenite is 35:65 to 65:35. According to one embodiment, the volume fraction of ferrite:austenite is 40:60 to 60:40, such as 50:50.

Hereinafter, the alloying elements of the duplex stainless steel as defined hereinabove or hereinafter are discussed, wherein wt % is weight %:

Carbon (C) is limited to a content of 0.03 wt % or less to secure the corrosion resistance of the duplex stainless steel. A content above 0.03 wt % will reduce the corrosion resistance and toughness due to the formation of chromium carbides.

Silicon (Si) is added in an amount of less than or equal to LO wt % to obtain deoxidation. However, above 1.0 wt %, Si will promote the precipitation of intermetallic phases, such as sigma phase, therefore the content of Si is 1.0 wt % or less, such as 0.6 wt % or less. According to one embodiment, the minimum amount of Si is 0.01 wt %. According to one embodiment, Si is in the range of from 0.2 to 0.6 wt %, such as 0.3 to 0.6 wt %.

Manganese (Mn) is added to most duplex stainless alloys because of its ability to bind sulphur, thereby improving the hot ductility. Mn has also an austenitic stabilizing effect. However, if Mn is added in concentrations above 2.0 wt %, such as 1.2 wt %, the corrosion resistance and toughness of the duplex stainless steel will be deteriorated. According to one embodiment, the minimum amount of Mn is 0.01 wt %. According to one embodiment, Mn is in the range of from 0.5 to 1.0 wt %, such as 0.7 to 0.9 wt %.

Phosphorous (P) will degrade the hot workability, weldability and toughness of the duplex stainless steel and is therefore limited to 0.05 wt % or less, such as 0.04% or less.

Sulphur (S) will also degrade the hot workability, toughness and corrosion resistance of the duplex stainless steel and is therefore limited to 0.05 wt % or less, such as 0.03 wt % or less.

Nickel (Ni) will stabilize the austenite structure of the duplex stainless steel and will also improve the corrosion resistance and the toughness. On the other hand, it is an expensive alloying element and it is therefore limited to a content of from 3.5 to 5.5 wt %, such as 3.5 to 5.0 wt %.

Chromium (Cr) is included in an amount of at least 21 wt % for securing good corrosion resistance of the duplex stainless steel. Cr will stabilize the ferritic structure of the duplex stainless steel. On the other hand, if the content of Cr is above 24.0 wt %, intermetallic compounds will more easily precipitate and thereby impair the toughness and corrosion resistance. Thus, the content of Cr is therefore of from 21.0 to 24.0 wt %, such as 22.0 to 23.5 wt %.

Molybdenum (Mo) is added for increasing the corrosion resistance and for stabilizing the ferrite phase. However, if Mo is added in too high amounts, it will promote the formation of intermetallic phases, which is detrimental for both the corrosion resistance and the toughness. In the present duplex stainless steel, Mo is therefore included in a range of 0.5 wt % or less, such as 0.3 wt % or less. According to one embodiment, the minimum amount of Mo is 0.01 wt %. According to one embodiment, the content of Mo is of from 0.2 to 0.4 wt %.

Nitrogen (N) is an element effective for enter solid solution in the austenite phase and also for raising the strength and corrosion resistance. For this reason, it is included in the present duplex stainless steel in an amount of 0.05 wt % or more. If contained above 0.20 wt %, N will cause nitrides to precipitate and thereby reduce the toughness and corrosion resistance. Thus, the content of N is between 0.05 to 0.20 wt %. According to one embodiment, the content of N is of from 0.09 to 0.18 wt %.

Tantalum (Ta) will form carbide, nitride and oxide precipitates, such as TaC, TaN, TaO and/or Ta(C,N). These are stable particles which are difficult to dissolve in a steel. In the present duplex stainless steel, it has surprisingly been found that if Ta is present in the amount of from 0.05 to 0.65 wt %, the strength of the duplex stainless steel will be increased. According to one embodiment, the content of Ta is of from 0.05 to 0.60 wt %. According to one embodiment, if the amount is of from 0.20 to 0.60 wt %, the strength of the present steel will be greatly improved.

The duplex stainless steel as defined hereinabove or hereinafter may optionally comprise one or more of the following elements selected from the group of Al, V, Nb, Ti, Zr, Hf, Mg, Ca, La, Ce, Y, Cu, W and B. These elements may be added during the manufacturing process in order to enhance e.g. deoxidation, corrosion resistance, hot ductility or machinability. However, as known in the art, the addition of these elements have to be adapted depending on which other alloying elements are present and on the desired effect. Thus, if added the total content of these elements is less than or equal to 1.0 wt %.

The term "impurities" as referred to herein is intended to mean substances that will contaminate the duplex stainless steel when it is industrially produced, due to the raw materials such as ores and scraps, and due to various other factors in the production process, and are allowed to contaminate within the ranges not adversely affecting the duplex stainless steel as defined hereinabove or hereinafter.

The present disclosure also relates to a method for manufacturing a product comprising the duplex stainless alloy as defined hereinabove or hereinafter, the method comprises the steps of:

providing a melt having the following composition:

C less than or equal to 0.03;
Si less than or equal to 1.0;
Mn less than or equal to 2.0;
Mo less than or equal to 0.5;
P less than or equal to 0.05;
S less than or equal to 0.05;
N 0.05 to 0.20;
Ni 3.5 to 5.5;
Cr 21.0 to 24.0;
Ta 0.05 to 0.65;
balance Fe and unavoidable impurities and a volume fraction of ferrite:austenite of 35:65 to 65:35;

casting the obtained melt to an object;

hot working the object;

optionally cold working the hot worked object;

heat treating the object during a predetermined time and at a temperature range of from 800 to less than 1050° C.

During the casting step, the obtained melt may be poured into a mold. As soon as the obtained melt is in the mold, it will begin to cool and the solidification starts. The obtained object is then removed from the mold. The melting point, as this is an alloy, will be a temperature range and will depend on the composition of the alloy.

The object will be hot worked. Examples of hot working methods are forging, hot rolling, and extrusion. The hot working step may include a combination of different hot working methods or the object may be hot worked several times using the same hot working method.

After the hot working step, the object may be cold worked or directly heat treated. Example of cold working methods are cold rolling and cold drawing. As for hot working, the cold working step may include one or more cold working methods which may be the same or different.

The heat treatment step is the most important step of the present manufacturing method, as it has surprisingly been shown that heat treatment will increase the strength of the obtained product. The heat treatment step is performed during a predetermined time, which will depend on the shape and the thickness of the product, example of a predetermined time is a range of from 10 minutes to 1 h, such as from 10 minutes to 30 minutes. The heat treatment is performed at a temperature of from 800 to 1050° C. In order to obtain even higher yield strength, the temperature of the heat treatment step may be in the range of 850° C. to 1000° C., such as 850 to 950° C., such as 850 to 900° C. According to one embodiment, the performed heat treatment is solution annealing.

After the heat treatment, the obtained product is cooled by e.g. quenching in liquid, such as water, or by using air cooling to room temperature.

The present disclosure is further illustrated by the following non-limiting examples.

Example 1

Table 1 shows the chemical composition of the manufactured heats, as can be seen from the table the heats are low duplex stainless steel as they contain low amount of Ni.

Since Ni and N are both austenite stabilizing alloying elements, they can compensate each other to a certain extent as shown in heat 10, i.e. to obtain structure stability of a duplex stainless steel, an increase in N may reduce the Ni content in the steel.

The alloys investigated were produced in the form of a cast ingot weighing 1 kg. The melting was performed by vacuum induction melting and then the melt was cast to ingots which were hot rolled to final dimensions of 7×7 mm at 1150° C. followed by air cooling.

Subsequently, the hot rolled objects were subjected to solution annealing treatment for 10 minutes at the respective temperatures as shown in Table 2, followed by water quenching. Solution annealing was performed to achieve nearly equal proportions of austenite (γ) and ferrite (α).

TABLE 1

Chemical composition of the duplex stainless steels heats- the given values are in wt %. The balance is iron and inevitable impurities. Heats marked with "*" are inside the scope of the disclosure.

| Heat | C | Si | Mn | Cr | Ni | Mo | N | Ta | Ti |
|---|---|---|---|---|---|---|---|---|---|
| 1 | 0.010 | 0.44 | 0.86 | 22.6 | 4.62 | 0.30 | 0.119 | — | — |
| 2* | 0.016 | 0.50 | 0.74 | 22.55 | 4.65 | 0.29 | 0.123 | 0.06 | 0.03 |
| 3* | 0.015 | 0.48 | 0.86 | 22.62 | 4.65 | 0.29 | 0.121 | 0.08 | 0.01 |
| 4* | 0.014 | 0.49 | 0.87 | 22.68 | 4.63 | 0.29 | 0.130 | 0.16 | — |
| 5* | 0.019 | 0.58 | 0.75 | 22.50 | 4.63 | 0.29 | 0.093 | 0.24 | 0.01 |
| 6* | 0.013 | 0.50 | 0.82 | 22.71 | 4.65 | 0.30 | 0.110 | 0.55 | — |
| 7* | 0.013 | 0.53 | 0.80 | 22.60 | 4.59 | 0.29 | 0.114 | 0.40 | 0.005 |
| 8 | 0.013 | 0.51 | 0.84 | 22.55 | 4.59 | 0.29 | 0.114 | 0.69 | 0.006 |

TABLE 1-continued

Chemical composition of the duplex stainless steels heats- the given values are in wt %. The balance is iron and inevitable impurities. Heats marked with "*" are inside the scope of the disclosure.

| Heat | C | Si | Mn | Cr | Ni | Mo | N | Ta | Ti |
|---|---|---|---|---|---|---|---|---|---|
| 9 | 0.015 | 0.53 | 0.86 | 22.77 | 4.64 | 0.29 | 0.123 | 0.81 | 0.004 |
| 10* | 0.014 | 0.53 | 0.84 | 23.06 | 3.66 | 0.29 | 0.174 | 0.58 | 0.004 |

Tensile Testing

Table 2 shows a summary of the tensile properties for the heats. As can be seen from the table, the addition of Ta in the range of 0.05-0.65 wt. % will have a combined effect both on the increase of Rp0.2 (yield strength) and Rm (tensile strength) compared with the reference samples (1, 8 and 9). As also can be seen from the Table 2, heat treatment of an object at 850-900° C. for 10-30 minutes of heat 1 (without Ta added) has an opposite effect compared to duplex stainless steels of the present disclosure, i.e. it resulted in a decrease in both Rp0.2 and Rm.

Tensile testing was performed on samples termed 4C30 (i.e. 4 mm in diameter and 30 mm in gauge length), the testing was performed at room temperature according to ISO6892-1:2009

For the duplex stainless steel according to the present disclosure, a heat treatment at the temperature range of 850 to 1050° C. shows an improvement in yield strength and tensile strength. However, an even better improvement is shown for the temperatures of 850, 900 and 950° C. when the samples are heat treated for 10 or 30 minutes. As can be seen from table 3, this will provide a significantly improvement in yield strength and tensile strength.

TABLE 2

The mechanical properties for the heats after heat treatment

| | Heat treatment | | | | | | | | | | |
|---|---|---|---|---|---|---|---|---|---|---|---|
| | Temperature | Time | $Rp_{0.2}$ | | Rm | | ALo20 | | | | |
| Heat | (° C.) | (min) | MPa | Stdv | MPa | Stdv | % | Stdv | $\%\Delta R_{p0.2}$ | $\%\Delta R_m$ | %ΔA |
| 1 | 1050 | 10 | 432.50 | 2.12 | 666.95 | 0.35 | 49.05 | 0.35 | 0.00 | 0.00 | 0.00 |
| 1 | 850 | 10 | 397.00 | 2.83 | 642.50 | 3.54 | 51.55 | 0.21 | −8.21 | −3.67 | 5.10 |
| 1 | 850 | 30 | 373.50 | 2.12 | 645.50 | 4.95 | 52.85 | 0.07 | −13.64 | −3.22 | 7.75 |
| 1 | 900 | 10 | 344.50 | 2.12 | 616.00 | 2.83 | 56.75 | 0.35 | −20.35 | −7.64 | 15.70 |
| 2* | 1050 | 10 | 454.50 | 6.36 | 681.50 | 2.97 | 44.90 | 0.28 | 5.09 | 2.18 | −8.46 |
| 3* | 1050 | 10 | 446.00 | 1.41 | 683.15 | 3.46 | 44.15 | 0.21 | 3.12 | 2.43 | −9.99 |
| 4* | 1050 | 10 | 449.50 | 0.71 | 694.15 | 1.20 | 44.40 | 0.14 | 3.93 | 4.08 | −9.48 |
| 5* | 1050 | 10 | 440.50 | 0.71 | 687.90 | 3.11 | 49.15 | 0.07 | 1.85 | 3.14 | 0.20 |
| 5* | 900 | 10 | 573.50 | 3.54 | 814.50 | 3.54 | 46.40 | 0.28 | 32.60 | 22.12 | −5.40 |
| 5* | 900 | 30 | 542.00 | 11.3 | 801.00 | 7.07 | 47.95 | 0.78 | 25.32 | 21.76 | −17.94 |
| 6* | 850 | 10 | 606.00 | 2.83 | 772.20 | 1.41 | 35.10 | 0.42 | 40.12 | 15.78 | −28.44 |
| 6* | 1000 | 10 | 500.50 | 7.78 | 713.15 | 1.41 | 41.50 | 0.00 | 15.72 | 6.93 | −15.39 |
| 6* | 850 | 30 | 611.00 | 2.83 | 839.00 | 1.41 | 44.80 | 0.57 | 41.27 | 25.80 | −8.66 |
| 6* | 900 | 10 | 659.50 | 1.41 | 813.00 | 4.24 | 46.10 | 0.85 | 52.49 | 21.90 | −6.01 |
| 7* | 1000 | 10 | 451.00 | 4.24 | 674.00 | 1.41 | 43.35 | 4.60 | 4.28 | 1.06 | −11.62 |
| 7* | 850 | 10 | 571.50 | 2.12 | 749.50 | 0.71 | 40.20 | 0.28 | 32.14 | 12.38 | −18.04 |
| 7* | 900 | 10 | 552.50 | 20.5 | 747.00 | 1.41 | 47.10 | 0.42 | 27.75 | 12.00 | −3.98 |
| 8 | 1000 | 10 | 436.50 | 2.12 | 665.00 | 2.83 | 50.10 | 0.57 | 0.92 | −0.29 | 2.14 |
| 8 | 850 | 10 | 427.00 | 8.49 | 697.50 | 3.54 | 50.80 | 1.84 | −1.27 | 4.58 | 3.57 |
| 9 | 1000 | 10 | 440.00 | 1.41 | 673.50 | 2.12 | 43.65 | 0.49 | 1.73 | 0.98 | −11.01 |
| 9 | 850 | 10 | 429.50 | 6.36 | 687.00 | 2.83 | 52.35 | 0.35 | −0.69 | 6.93 | 6.73 |
| 10* | 1000 | 10 | 511.00 | 12.7 | 730.50 | 2.12 | 38.35 | 1.06 | 18.15 | 9.53 | −21.81 |
| 10* | 850 | 10 | 574.00 | 2.83 | 777.50 | 3.54 | 34.60 | 0.00 | 32.72 | 21.01 | −29.46 |
| 10* | 900 | 10 | 555.50 | 3.54 | 770.50 | 2.12 | 37.75 | 0.07 | 28.44 | 15.53 | −23.04 |
| 10* | 1050 | 10 | 483.50 | 2.10 | 718.00 | 0.00 | 37.90 | 1.20 | 11.79 | 7.65 | −22.73 |
| 10* | 950 | 10 | 533.00 | 9.90 | 748.00 | 9.90 | 37.40 | 1.70 | 23.24 | 12.15 | −23.75 |

The invention claimed is:

1. A duplex stainless steel comprising a composition consisting of, in weight (wt %):
C less than or equal to 0.03;
Si 0.2 to 0.6;
Mn 0.7 to 0.9;
Mo 0.2 to 0.4;
P less than or equal to 0.04;
S less than or equal to 0.03;
N 0.05 to 0.20;
Ni 3.5 to 5.0;
Cr 22.0 to 23.5;
Ta 0.20 to 0.60;
optionally one or more of V, Nb, Ti, Zr, Hf, Mg, Ca, La, Ce, Y, Cu, W and B in a total content of less than or equal to 1.0;
balance Fe and unavoidable impurities, and
having a ferrite:austenite volume fraction of 40:60 to 60:40.

2. The duplex stainless steel according to claim 1, wherein the content of N is of from 0.09 to 0.18 wt %.

3. A method comprising the steps of:
providing a melt having a composition consisting of, in weight (wt %):
C less than or equal to 0.03;
Si 0.2 to 0.6;
Mn 0.7 to 0.9;
Mo 0.2 to 0.4;
P less than or equal to 0.04;
S less than or equal to 0.03;
N 0.05 to 0.20;
Ni 3.5 to 5.0;
Cr 22.0 to 23.5;
Ta 0.20 to 0.60;
optionally one or more of V, Nb, Ti, Zr, Hf, Mg, Ca, La, Ce, Y, Cu, W and B in a total content of less than or equal to 1.0;
balance Fe and unavoidable impurities;
casting the obtained melt to obtain an object;
hot working the object;
optionally cold working the hot worked object; and
heat treating the hot worked object or cold worked object during a predetermined time and at a temperature range of from 850 to 950° C. to obtain a product,
wherein the product has a microstructure including a volume fraction of ferrite:austenite of 40:60 to 60:40.

4. The method according to claim 3, wherein the content of N is of from 0.09 to 0.18 wt %.

5. The method according to claim 3, wherein the temperature is in the range of 850 to 900° C.

6. The method according to claim 3, wherein the heat treating is a solution heat treatment.

7. A product comprising the alloy according to claim 1.

8. The product according to claim 7, wherein said product has been manufactured by a method comprising the steps of:
providing a melt having a composition consisting of, in weight (wt %):
C less than or equal to 0.03;
Si 0.2 to 0.6;
Mn 0.7 to 0.9;
Mo 0.2 to 0.4;
P less than or equal to 0.04;
S less than or equal to 0.03;
N 0.05 to 0.20;
Ni 3.5 to 5.0;
Cr 22.0 to 23.5;
Ta 0.20 to 0.60;
optionally one or more of V, Nb, Ti, Zr, Hf, Mg, Ca, La, Ce, Y, Cu, W and B in a total content of less than or equal to 1.0;
balance Fe and unavoidable impurities;
casting the obtained melt to obtain an object;
hot working the object;
optionally cold working the hot worked object; and
heat treating the hot worked object or cold worked object during a predetermined time and at a temperature range of from 850 to 950° C. to obtain the product,
wherein the product has a microstructure including a volume fraction of ferrite:austenite of 40:60 to 60:40.

9. The duplex stainless steel according to claim 1, wherein the volume fraction of ferrite:austenite is 50:50.

10. The product according to claim 8, wherein the content of N is of from 0.09 to 0.18 wt.

11. The product according to claim 10, wherein the volume fraction of ferrite:austenite is 50:50.

12. The product according to claim 8, wherein the volume fraction of ferrite:austenite is 50:50.

13. The product according to claim 8, wherein the temperature is in the range of 850 to 900° C.

14. The product according to claim 8, wherein the heat treating is a solution heat treatment.

15. The method according to claim 3, wherein the volume fraction of ferrite:austenite is 50:50.

* * * * *